US007192296B1

(12) United States Patent
Little et al.

(10) Patent No.: US 7,192,296 B1
(45) Date of Patent: Mar. 20, 2007

(54) LATCHABLE ELECTRICAL CONNECTOR

(75) Inventors: Terrance F. Little, York, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,236

(22) Filed: Jul. 3, 2006

(51) Int. Cl.
*H01R 13/627* (2006.01)

(52) U.S. Cl. ..... 439/358

(58) Field of Classification Search ..... 439/352–358
See application file for complete search history.

(56) References Cited

U.S. PATENT DOCUMENTS 4,681,387 A 7/1987 Paddock
5,342,215 A * 8/1994 Silbernagel et al. ..... 439/357
5,879,194 A * 3/1999 Thenaisie et al. ..... 439/607
6,250,943 B1 * 6/2001 Castle et al. ..... 439/352
6,312,277 B1 * 11/2001 Holub ..... 439/352
6,361,346 B1 * 3/2002 Matsuoka ..... 439/352
6,364,686 B2 * 4/2002 Gimbel ..... 439/357
6,371,788 B1 * 4/2002 Bowling et al. ..... 439/358
6,558,183 B1 * 5/2003 Ji et al. ..... 439/358

* cited by examiner

*Primary Examiner*—Briggitte R. Hammond
(74) *Attorney, Agent, or Firm*—Wei Te Chung

(57) ABSTRACT

The present invention provides an electrical connector (100) used to be inserted into a receptacle (80) mounted on a substrate. The electrical connector comprises a connector body (20), a latching lever (40) attached onto said connector body and being rotatable therearound between a first position where the latching lever engages the receptacle and a second position where the latching lever disengages the receptacle, and a pull strap (60) slidably mounted onto the connector body. The pull strap drives the latching lever to the second position when the pull strap slides along a sliding direction.

20 Claims, 8 Drawing Sheets

LATCHABLE ELECTRICAL CONNECTOR

BACKGROUND OF THE INVENTION

1. Field of the Invention

The present invention relates to an electrical connector used for electrically connecting a cable to a backplane connector, and more particularly, relates to an electrical connector having an operatable latch device which is convenient to be operated in a limited space.

2. Description of the Prior Art

A conventional cable connector having an operatable latch device is disclosed in U.S. Pat. No. 6,371,788 issued on Aug. 30, 1994. A cable connector used to mate into a backplane connector comprises a plurality of wafer connectors; a stiffener member for engaging said plurality of connectors and retaining said plurality of connectors together as a block; a latching lever for latching said block of connectors to said backplane connector in mating engagement therewith, the latching lever being movable between first and second operative positions; an attachment member for movably attaching said latching lever to said stiffener member; said latching lever having an elongated body portion extending between first and second opposing ends, said first end having an engagement hook disposed thereon for engaging a portion of said backplane connector and said second end having a gripping portion for manipulation by a user, said latching lever further having a biasing member that extends therefrom and into contact with said stiffener member to bias said latching lever into said first operative positions wherein said latching lever first end is engaged with said backplane connector to thereby latch said connector block in place in engagement with said backplane connector. However, when used in a circumstance where the connectors are arranged side by side, there is rather limited space for a hand to operate the latching lever.

Hence, an improved electrical connector is needed to solve the above problem.

BRIEF SUMMARY OF THE INVENTION

One object of the present invention is to provide an electrical connector having an improved latch device which can be conveniently operated in a limited space.

The present invention provides an electrical connector used to be inserted into a receptacle mounted on a substrate defining an inserting and extracting direction, said connector comprising a connector body, a latching lever, and a pull strap slidably mounted onto the connector body. The latching lever comprises a shaft portion rotatably attached onto the connector body, a flexible arcuate portion extending from the shaft portion along the extracting direction and slantwise away from the connector body, a deflecting portion extending from the arcuate portion along the extracting direction and slantwise towards the connector body and abutting thereon. The pull strap includes a pressing block corresponding to the arcuate portion, so that when the pull strap slides along the inserting direction, the arcuate portion is pressed close to the connector body or released away from the connector body.

Other objects, advantages and novel features of the invention will become more apparent from the following detailed description of the present embodiments when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
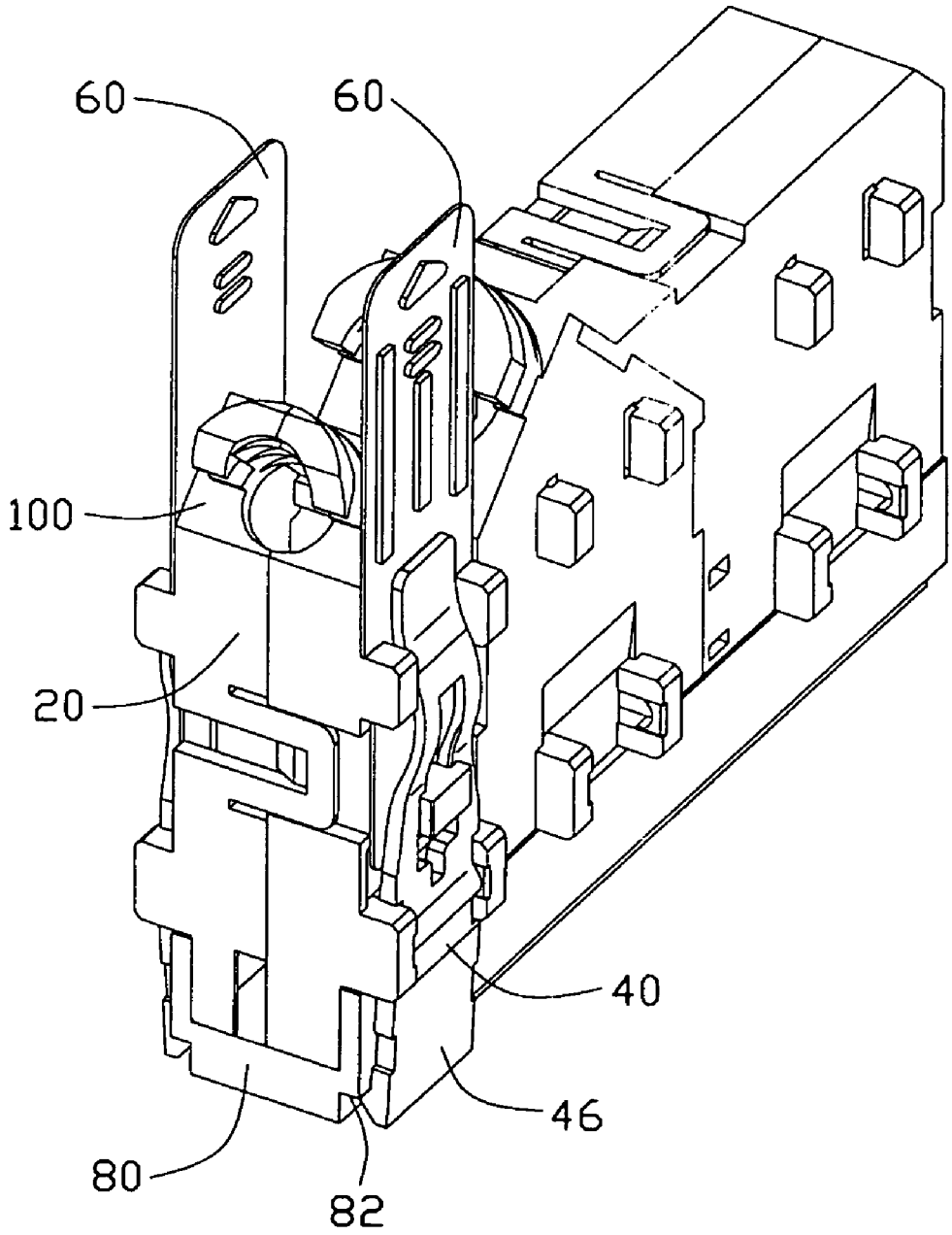
FIG. 1 is a perspective view of several electrical connectors (only one is completely shown for a clearer view) in accordance with a first embodiment of the present invention.

Reference will now be made to the drawing figures to describe the present invention in detail.

FIG. 1 shows several electrical connectors (only one electrical connector 100 is completely shown for a clearer view) according to a first embodiment of the present invention. The electrical connector 100 is used for mating with a receptacle 80 mounted on a substrate (not shown) and defines an inserting direction, an extracting direction opposite to the inserting direction and a side direction perpendicular to the inserting and extracting directions. The electrical connector 100 comprises a connector body 20, a pair of latching levers 40 and a pair of pull straps 60.

Figure 2:
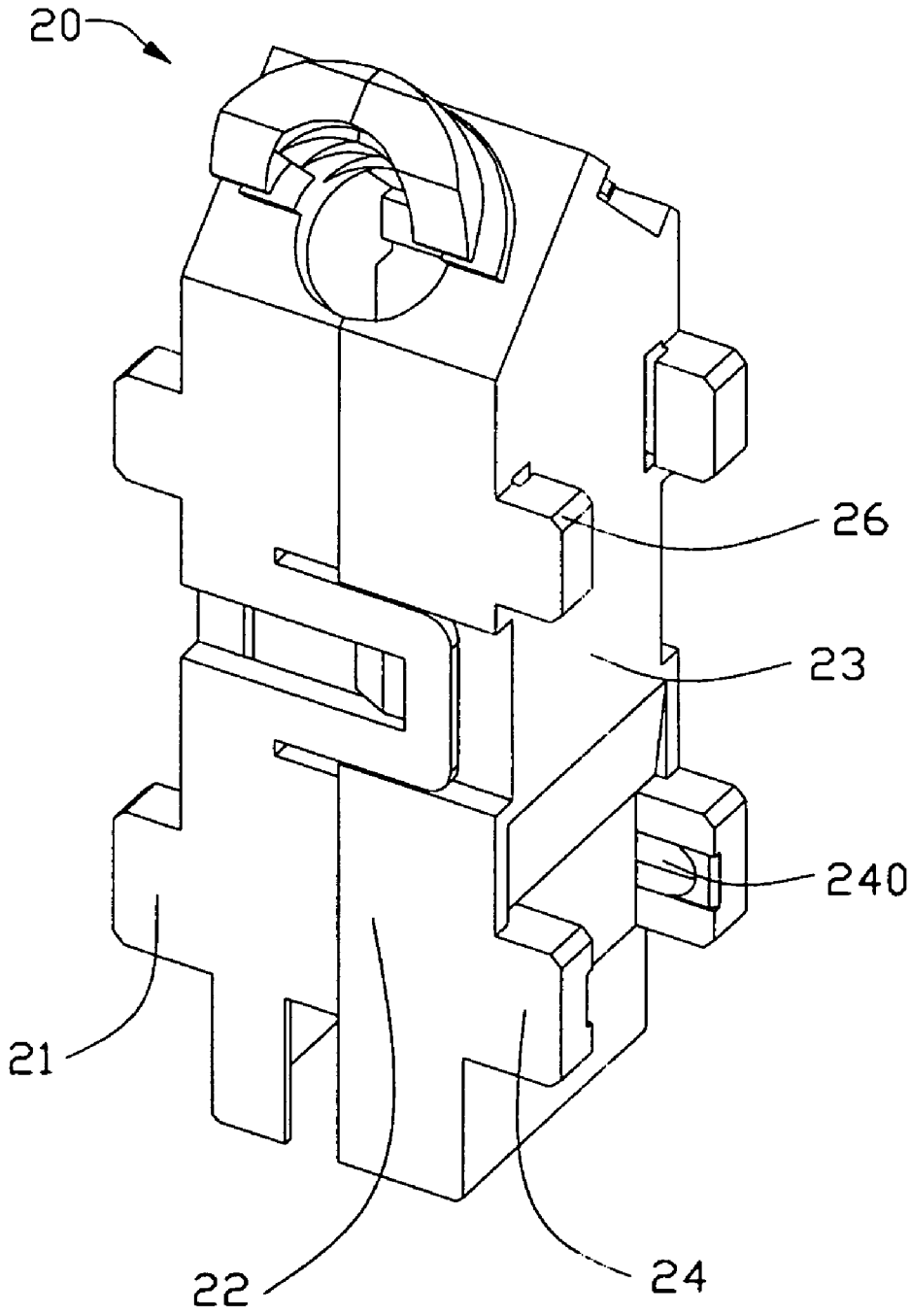
FIG. 2 is a perspective view of a connector body of FIG. 1.
Figure 3:
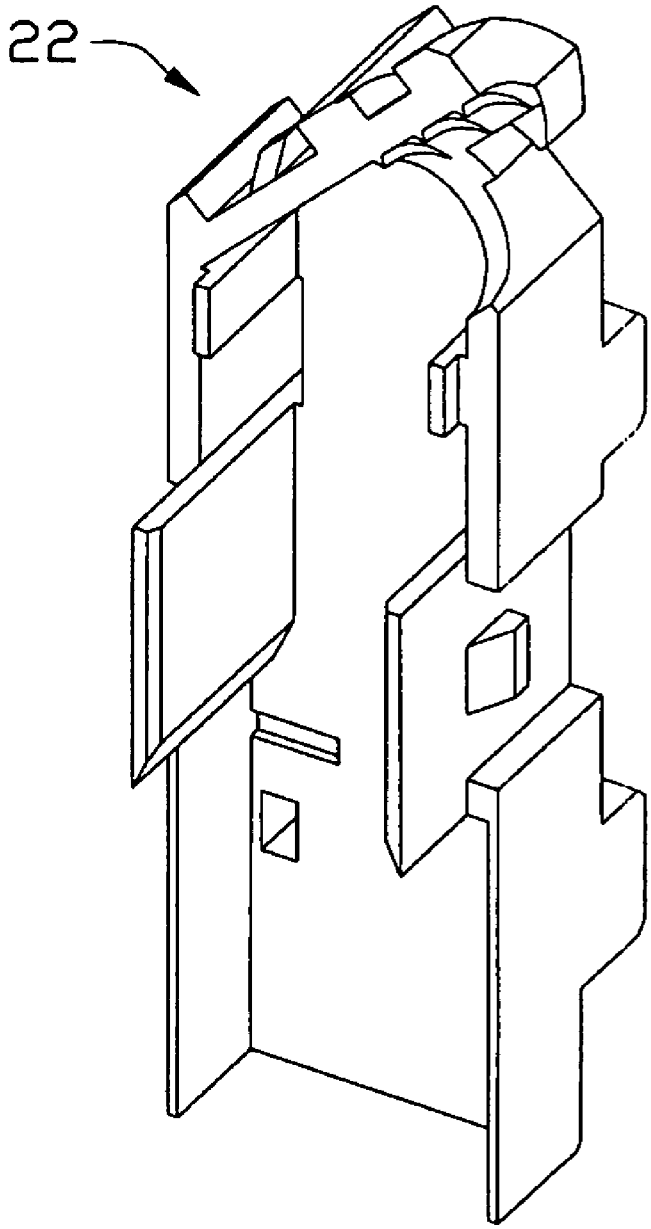
FIG. 3 is another perspective view of an insulative cover for the connector body of FIG. 2.

As shown in FIGS. 2, 3, the connector body 20 comprises a pair of insulative covers 21,22 cooperatively defining a cavity and a plurality of connector modules (not shown) received in the cavity. Each of the covers 21,22 forms a side wall 23 perpendicular to the side direction. The side wall 23 forms a pair of mutually opposite hubs 24 at a lower height and a pair of mutual opposite gibs 26 at a higher height. The hubs 24 define a pair concavities 240 face to face for mating with the latching lever 40. The pair of gibs 26 defines a guiding path extending along the inserting direction for the pull strap 60 to slide thereinto.

Figure 4:
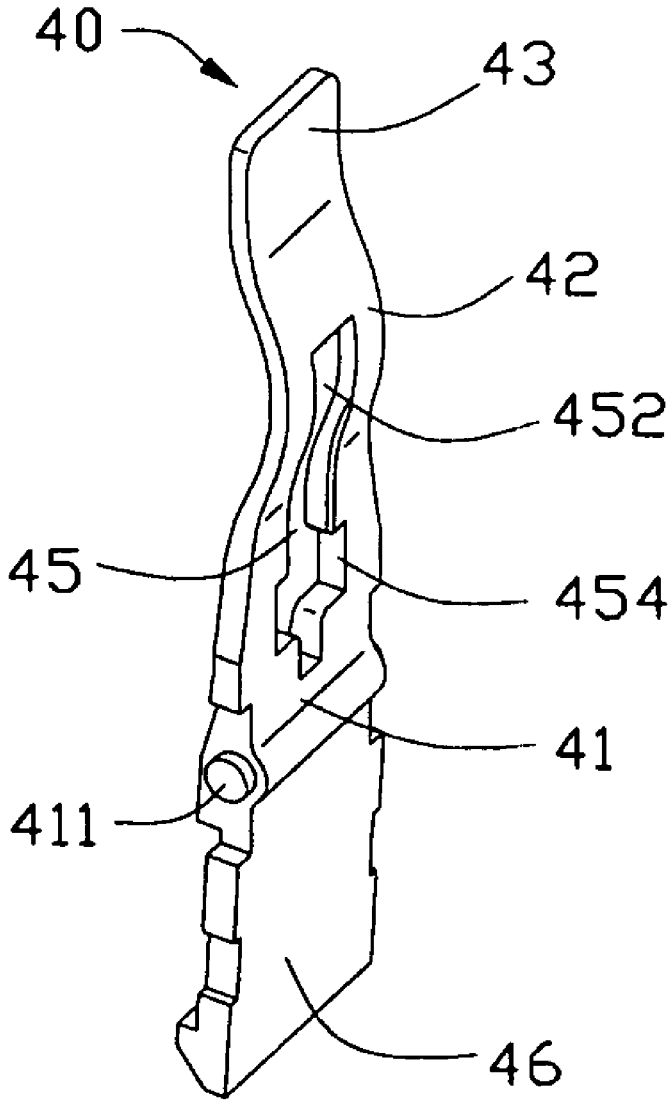
FIG. 4 is a perspective view of a latching lever of FIG. 1.

As shown in FIG. 4, the latching lever 40 comprises a shaft portion 41 rotatably attached onto the hub 24, an arcuate portion 42 extending from the shaft portion 41 along the extracting direction and slantwise away from the side wall 23 and then returning slantwise towards the side wall 23, a flexible deflecting portion 43 extending from the arcuate portion 42 along the extracting direction and abutting the side wall 23 of FIG. 2, and a hook portion 46 extending from the shaft portion 41 along the inserting direction. The latching lever 40 defines in the center a receiving slot 45 cutting therethrough in the side direction. The receiving slot 45 comprises a wider portion 454 near the shaft portion 41 and a narrow portion 452 communicating the wider portion 454 and extending to a center point of the arcuate portion 42. The shaft portion 41 forms a pair of shafts 411 oppositely projecting therefrom and respectively mating into corresponding concavities 240 defined in the hubs 24 of FIG. 2.

Figure 5:
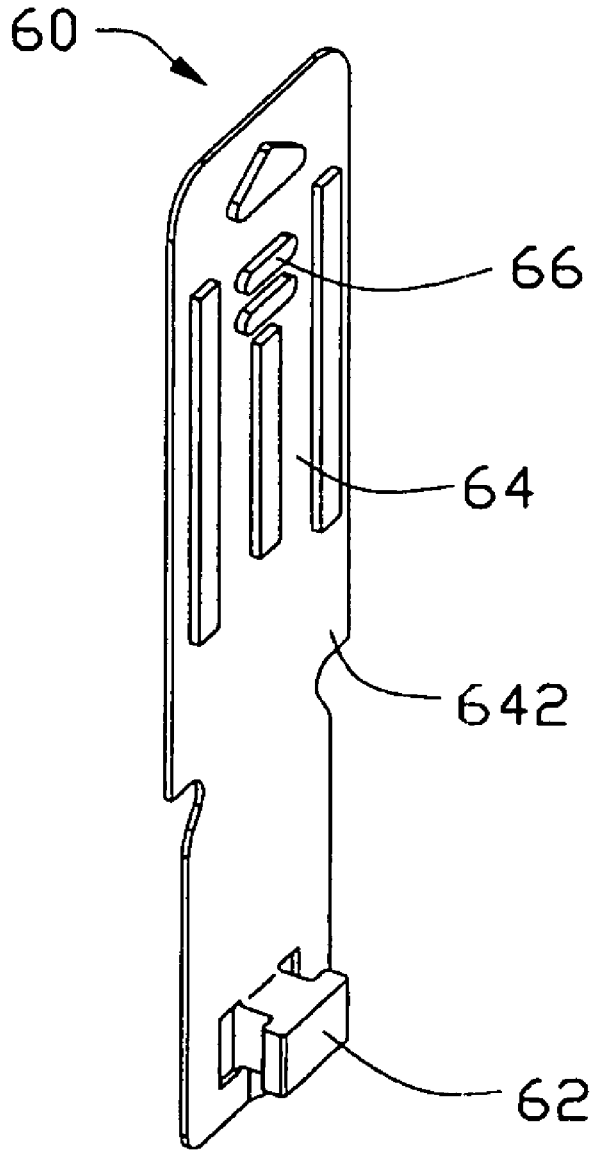
FIG. 5 is a perspective view of a pull strap of FIG. 1.

As shown in FIG. 5, the pull straps 60 are injection molded and comprises a plate-liked strip 64 extending along the inserting direction and a pressing portion 62 projecting from the strip 64. The strip 64 has a first end forming a pulling portion 66, for gripping by the operator, and a second end where the pressing portion 62 projects perpendicularly therefrom. Furthermore, the strip 64 forms a pair of positioning stops 642, which limit the downward travel of the pull straps, are opposite to each other in a direction perpendicular to both the inserting direction and the side direction.

Figure 6:
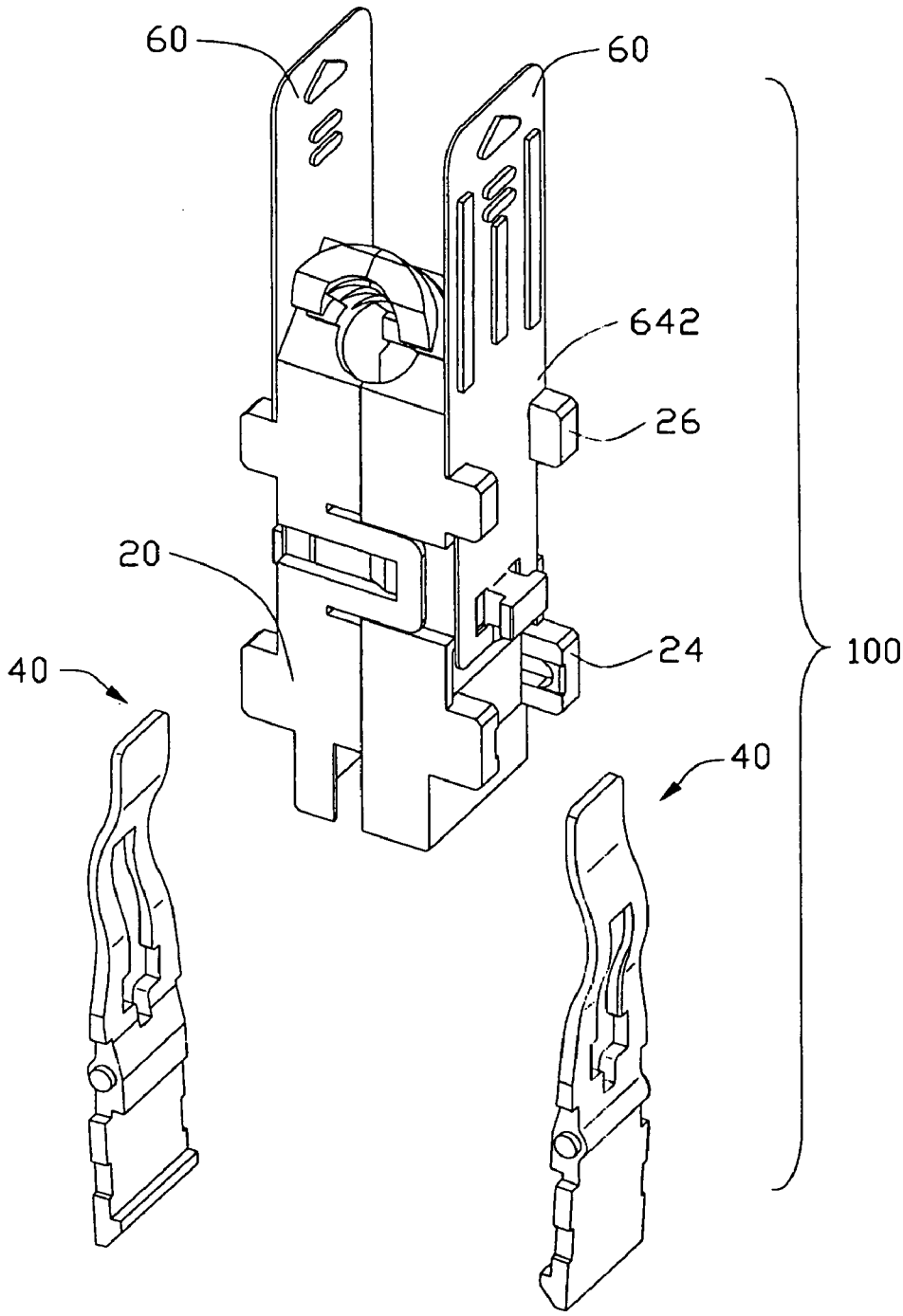
FIG. 6 is a perspective view of the connector body with the pull strap firstly arranged thereon.
Figure 7:
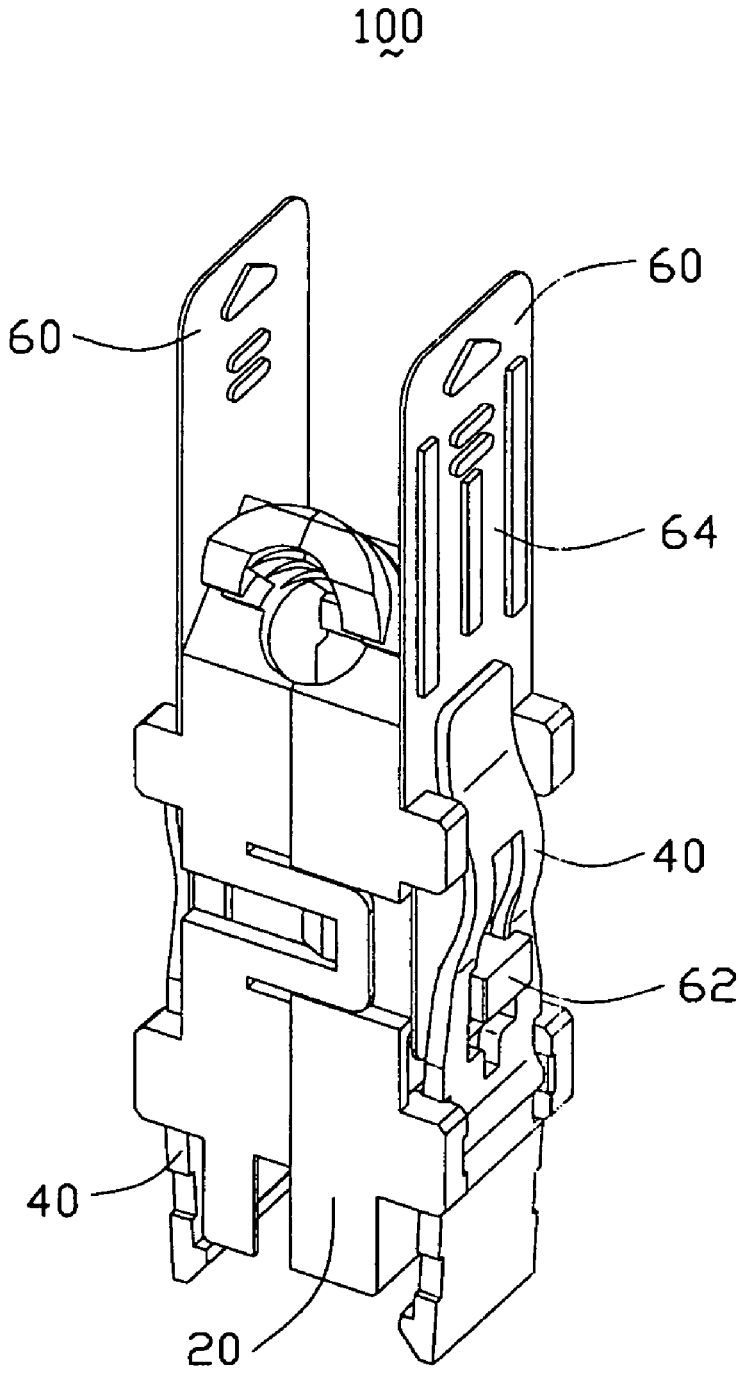
FIG. 7 is a perspective view of the electrical connector with the lever and pull straps mounted thereon.

When an electrical connector 100 according to the present invention is assembled, a connector body 20, a pair of latching levers 40 and a pair of pull straps 60 are firstly provided. Then, as shown in FIG. 6, the pull straps are respectively inserted along a guiding path defined by the pair of gibs 26 on the side wall 23 until the positioning stops 642 abutting the gibs 26. Thirdly, one of the pair of latching levers 40 is perpendicularly put onto corresponding side walls 23 with the pressing portion 62 aligned with the wider portion 454 of the slot 45 and passing therethrough, when the shafts 411 of the shaft portion 41 are disposed at a position upwardly of the hubs 24 of the connector body 20, the strip 64 is disposed between the latching lever 40 and the connector body 20 and the pressing portion 62 is disposed outside of the latching lever 40. Fourthly, the latching lever 40 is pulled down until the shafts 411 are aligned to the concavities 240 of the hubs 24 in the side direction. Fifthly, the shaft portion 41 is pressed towards the connector body 20 so that the shafts 411 are forced into the concavities 240 of the hubs 24. Then, the steps 3–5 are repeated so the left latching lever 40 is mounted onto the other side wall 23 of the connector body 20.

When the electrical connector 100 is inserted into the mating receptacle 80, the latching levers 40 are disposed at a first position where the hook portions 46 of the latching levers 40 engage a pair of steps 82 defined on the mating receptacle 80, as shown in FIG. 1. When there is a need to extract the electrical connector 100 therefrom, the pulling portions 66 of the pull straps 60 are pulled upward and the pressing portions 62 slide upwardly, so as to press the arcuate portion 42 towards the connector body 20, so that the latching levers 40 are driven to a second position where the hook portion 46 rotates around the shaft portion 41 and breaks away from the steps 82 of the mating receptacle 80.

Figure 8:
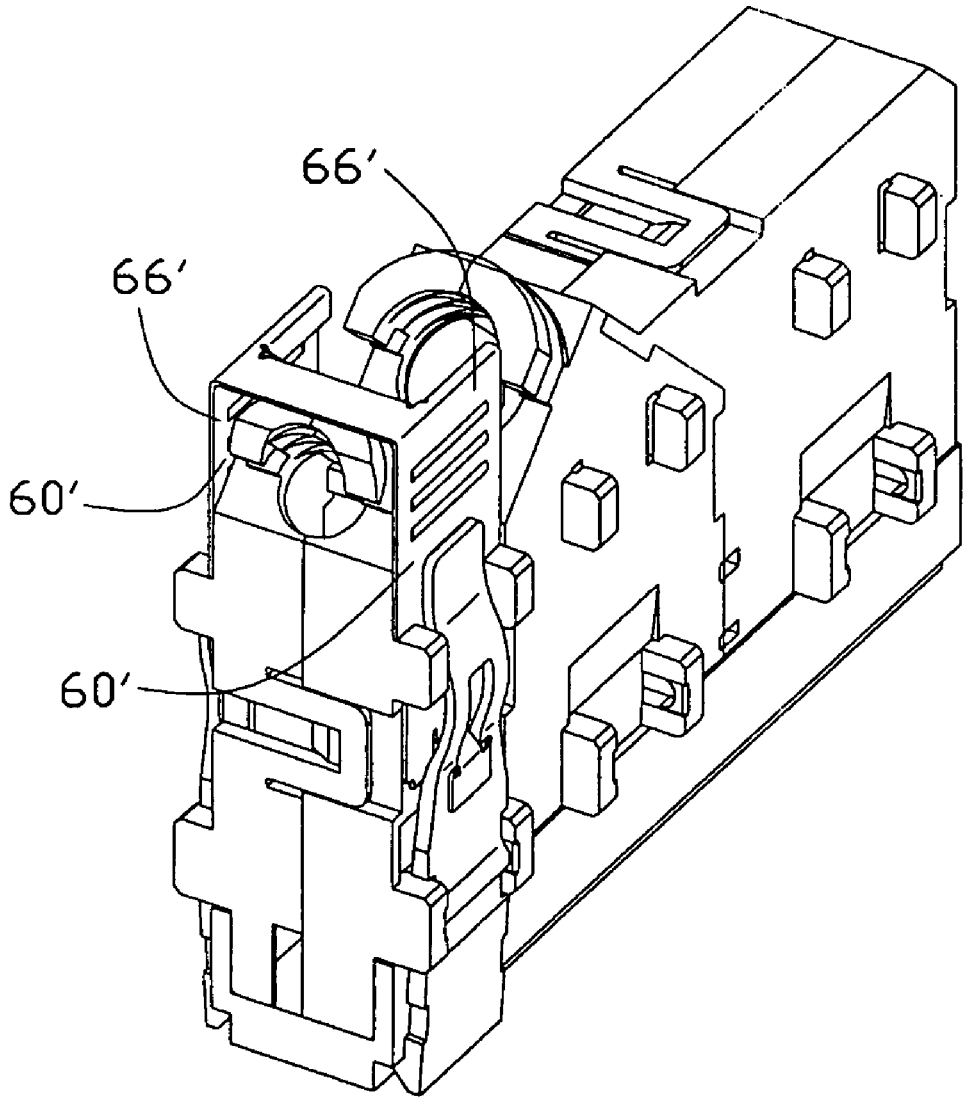
FIG. 8 is a perspective view of an electrical connector of a second embodiment in accordance with the principles of the present invention.

A second embodiment according to the present invention is disclosed as FIG. 8. The difference of the second embodiment from the first embodiment is that the pull straps 66' are the pulling portions 66' of the pull straps 60' are connected together.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector used to be inserted into a receptacle mounted on a substrate, said electrical connector comprising:

a connector body for establishing electrical connection with the receptacle;

a latching lever mounted onto said connector body and being rotatable around a first position where the latching lever engages the receptacle and a second position where the latching lever disengages the receptacle; and a pull strap slidably mounted onto said connector body and defining a first sliding direction and a second sliding direction opposite to said first sliding direction; wherein said pull strap engages said latching lever and drives said latching lever to said second position when said pull strap slides along said second sliding direction.

2. The electrical connector according to claim 1, wherein said latching lever comprises a floating cantilever defining a slope extending slantwise relative to the first and second sliding directions and said pull strap comprises a pressing block for mating with the slope.

3. The electrical connector according to claim 2, wherein the connector body comprises a pair of insulating covers cooperatively defining a cavity and a plurality of connector modules received in the cavity.

4. The electrical connector according to claim 2, wherein said first and second sliding directions are parallel to an inserting direction of the electrical connector into the receptacle.

5. The electrical connector according to claim 4, wherein the connector body forms a side wall parallel to the inserting direction and said side wall forms a pair of gibs defining a guiding path for the pull strap to slide therein.

6. The electrical connector according to claim 4, wherein the latching lever comprises a deflecting device for automatically rotating the latching lever to said first position when said pull strap slides along the first sliding direction.

7. The electrical connector according to claim 6, wherein the deflecting device comprises a deflecting portion extending from a distal end of the floating cantilever, said deflecting portion flexibly abutting said connector body.

8. The electrical connector according to claim 7, wherein the latching lever further comprises a shaft portion rotatably attached to said connector body.

9. The electrical connector according to claim 8, wherein the floating cantilever extends from said shaft portion and has an arcuate portion connecting said deflecting portion and said shaft portion, said slope located on an outside of said arcuate portion.

10. The electrical connector according to claim 8, wherein the latching lever comprises a hook portion extending from the shaft portion along the inserting direction.

11. An electrical connector used to be inserted into a receptacle mounted on a substrate defining an inserting direction, an extracting direction opposite to the inserting direction and a side direction perpendicular to the inserting and extracting directions, said electrical connector comprising:

a connector body defining a side wall perpendicular to said side direction;

a latching lever comprising:

a shaft portion rotatably attached onto said side wall;

an arcuate portion extending from the shaft portion along the extracting direction and slantwise away from the side wall; and a deflecting portion extending from the arcuate portion along the extracting direction and flexibly abutting the side wall; and a pull strap slidably arranged along the side wall, said pull strap including a pressing block corresponding to the arcuate portion, so that when the pull strap slides along the extracting or the inserting direction, the pressing portion deforms and presses the arcuate portion close to the side wall or releases the arcuate portion away from the side wall.

12. The electrical connector according to claim 11, wherein the latching lever comprises a hook portion extending from the shaft portion along the inserting direction for latching said receptacle.

13. The electrical connector according to claim 11, wherein the shaft portion of the lever forms a pair of shafts extending oppositely and wherein the side wall forms a pair of hubs for receiving said pair of shafts so that the lever is rotatably fastened to the connector body.

14. The electrical connector according to claim 11, wherein the side wall forms a pair of gibs defining a guiding path for the pull strap to slide therealong.

15. The electrical connector according to claim 11, wherein the pull strap comprises a strip extending along the inserting direction, said strip having a first end connecting to said pressing portion and a second end forming a pulling portion.

16. The electrical connector according to claim 15, wherein the lever defines a slot, the slot comprising a wider portion near the shaft portion for the pressing block to pass therethrough and a narrower portion extending from the wider portion along the extracting direction to a center portion of the arcuate portion, so that the strip can be disposed between the side wall and the lever and the pressing block is disposed outside of the lever.

17. The electrical connector according to claim 11 further comprising another lever and another pull strap, and wherein said levers and pull straps are symmetrically arranged.

18. The electrical connector according to claim 17, wherein the pulling portions of the pull straps are connected together.

19. An electrical connector comprising:

a connector body;

a latching lever mounted onto said connector body and being rotatable around a first position and a second position; and a pull strap mounted onto said connector body and moveable along a front-to-back direction;

interengagement devices are formed on both said latching lever and said pull strap so as to result in a correlative movement therebetween, wherein at least one of said pull strap and said latching lever is equipped with a bulged structure on the corresponding interengagement device so as to result in not only rotation of latching lever when said pull strap is linearly moved but also resumption of the latching lever after a pull force applied to the pull strap is removed.

20. The connector as claimed in claim 19, wherein a pivot of said lever is located in front of said interengagement device.

* * * * *